US006092740A

United States Patent [19]

Liu

[11] Patent Number: 6,092,740

[45] Date of Patent: Jul. 25, 2000

[54] STRUCTURE OF A PAINT CONTAINER FOR SPRAY GUN

[76] Inventor: Horng-Hsiang Liu, No. 8, Lane 45, Che Lu Tou St., San Chung City, Taipei Hsien, Taiwan

[21] Appl. No.: 09/377,424

[22] Filed: Aug. 20, 1999

[51] Int. Cl.[7] ..... B05B 7/30

[52] U.S. Cl. ..... 239/346; 239/378; 285/190

[58] Field of Search ..... 239/345, 346, 239/376–379, 318; 285/190

[56] References Cited

U.S. PATENT DOCUMENTS

| | | | |
|---|---|---|---|
| 2,961,335 | 11/1960 | Shepard | 239/378 X |
| 3,236,459 | 2/1966 | McRitchie | 239/376 X |
| 4,775,174 | 10/1988 | Bona et al. | 285/190 X |
| 4,955,643 | 9/1990 | Bona et al. | 285/190 |
| 4,978,072 | 12/1990 | Kurowski | 239/379 X |
| 5,069,389 | 12/1991 | Bitsakos | 239/346 X |
| 5,366,158 | 11/1994 | Robisch et al. | 239/346 X |
| 5,582,350 | 12/1996 | Kosmyna et al. | 239/346 X |
| 5,803,360 | 9/1998 | Spitznagel | 239/377 X |
| 5,918,815 | 7/1999 | Wu | 239/379 X |
| 6,012,651 | 1/2000 | Spitznagel | 239/377 X |

FOREIGN PATENT DOCUMENTS

| | | | |
|---|---|---|---|
| 1512675 | 10/1989 | U.S.S.R. | 239/345 |
| 139833 | 10/1989 | United Kingdom | 239/345 |

*Primary Examiner*—Lesley D. Morris
*Attorney, Agent, or Firm*—Rosenberg, Klein & Lee

[57] ABSTRACT

A spray gun paint container includes an L-shaped connector, a horizontal connector, and a spray gun along with the paint container, whereas the front end of the spray gun is integrally formed with a top connecting head which is connected with the L-shaped connector which then connected with the horizontal connector and the paint container is in turn connected with the horizontal connector, thus the container is able to rotate in 360 degrees with respect to the horizontal connector, and the L-shaped connector is also able to rotate in 360 degrees with respect to the spray gun, and hence the container is able to rotate with respect to the spray gun.

7 Claims, 9 Drawing Sheets

STRUCTURE OF A PAINT CONTAINER FOR SPRAY GUN

BACKGROUND OF THE INVENTION

1. Field of the Invention

This invention relates to a design of a spray gun having a container which is able to rotate and is able to adjust its angle to prevent any dead spot.

2. Prior Art

The spray gun of prior art, as shown in FIG. 9, comprises a spray gun A and a paint container C secured by a connecting wrench B to a connector A2 which is close to the nozzle A1 of the gun in an inclining states. This design has some shortcomings:

1. The weight falls onto the front end of the handle which causes user's wrist to ache after a long time holding the gun.
2. The container is in a fixed position which has a height that will cause problem in getting into interior of some limited space.
3. In painting an object at a higher position, the gun will be held in such a way that the nozzle will face upward and the paint within the container will not drain into the nozzle.

In view of this, the inventor has invented the present invention to improve the shortcomings.

SUMMARY OF THE INVENTION

It is the primary object of the present invention to provide a structure of a container for spray gun which paint container is able to rotate with respect to the nozzle, thus the spray gun is adjustable to fit into various spaces.

It is another object of the present invention to provide a structure of a paint container for spray gun which is easy to operate.

It is a further object of the present invention to provide the structure of a paint container for a spray gun which is cost effective.

DESCRIPTION OF THE PREFERRED EMBODIMENTS

Figure 1:
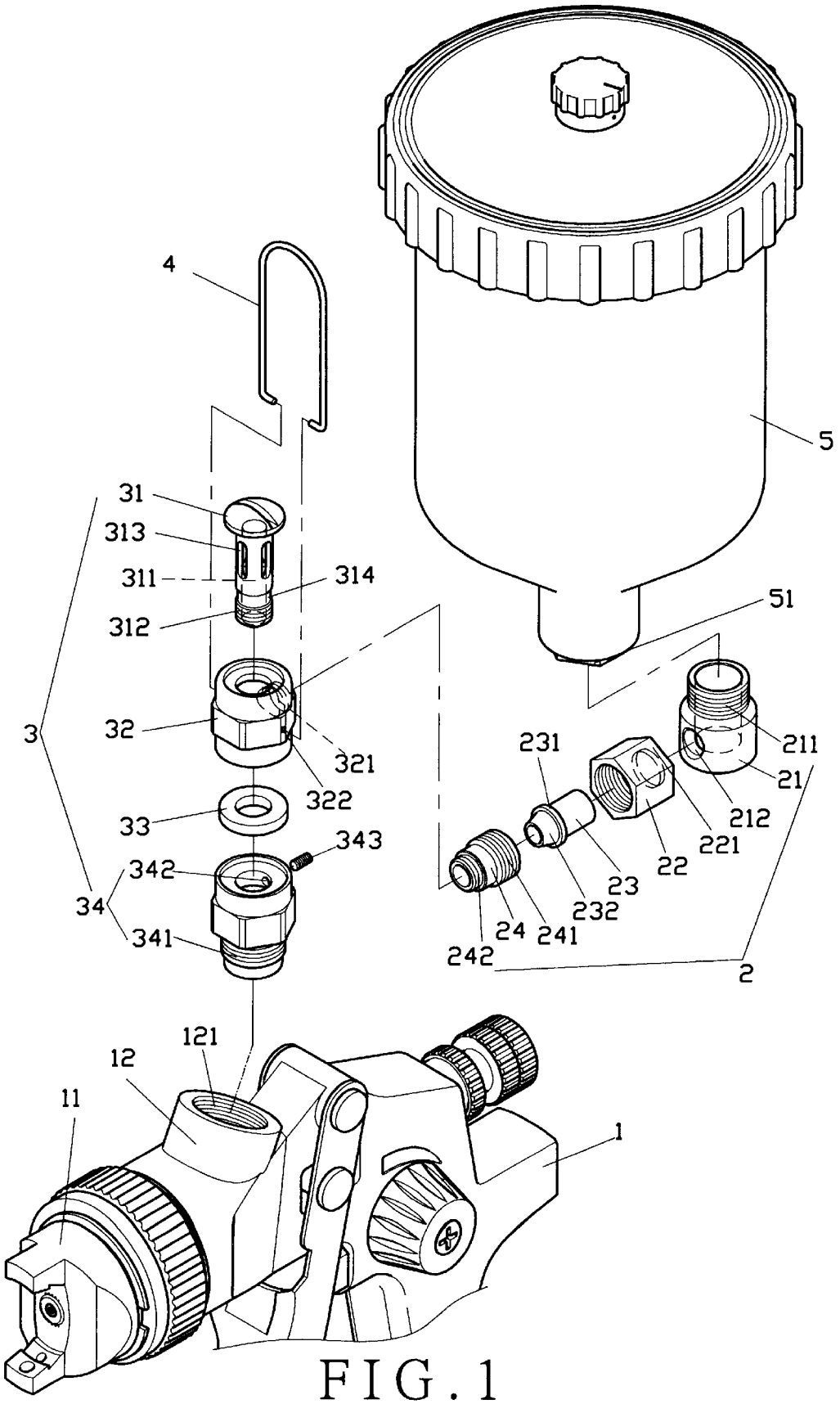
FIG. 1 is an exploded view of the present invention.

The spray gun of the present invention, as shown in FIG. 1, comprises an L-shaped connector 2, a horizontal connector 3 and a clip 4 installed on a spray gun 1 and a paint container 5, wherein the spray gun 1 is a prior art, so will not be described in general but the modification, hereinafter.

The spray gun 1 has a top connecting head 12 which is close to the nozzle 11 and having female threads 121, the top connecting head 12 is connected to the spray gun 1 internally.

The L-shaped connector 2 is composed of a barrel 21, a bolt 22, a socket 23 and a connecting pipe 24. The barrel 21 is a hollow body with an opening at one side which is formed with threads 211, an opening 212 at one side thereof The bolt 22 has a small flange 221. The socket 23 has a hollow body with a ring of flange 231 extending outwardly and a cone 232 at one end thereof. The connecting pipe 24 also has a hollow body with a pair of threaded portions 241 and 242, one large threads 241 is formed on one end and a small threads 242 on the other end, an inner cone wall is formed at the end corresponding to the cone 232.

The horizontal connector 3 includes a shaft 31, a connecting wrench 32, a washer 33 and a sleeve 34. The shaft 31 has an aperture 311 along the axle, one end of the shaft 31 has a slot for screwdriver to hold its position thereon, while the other end of which has a thread 312, longitudinal slots 313 are formed along the wall of the shaft 31 that interconnected with the aperture 311, a ditch 314 is formed thereon. The connecting wrench 32 is in a hexagonal shape with a through threaded hole 321 along the axle, two locators 322 are formed thereon and corresponding to each other. The sleeve 34 has a hollow body, with female threads 341 formed at one end and a pin hole 342 at the other end for a pin 343 to insert therein.

The clip 4 is formed by bending a material into U-shape with the two ends bend inwardly to match and to be inserted into the locators 322 of the connecting wrench 32.

The paint container 5 has a threaded portion at its opening 511.

Figure 2:
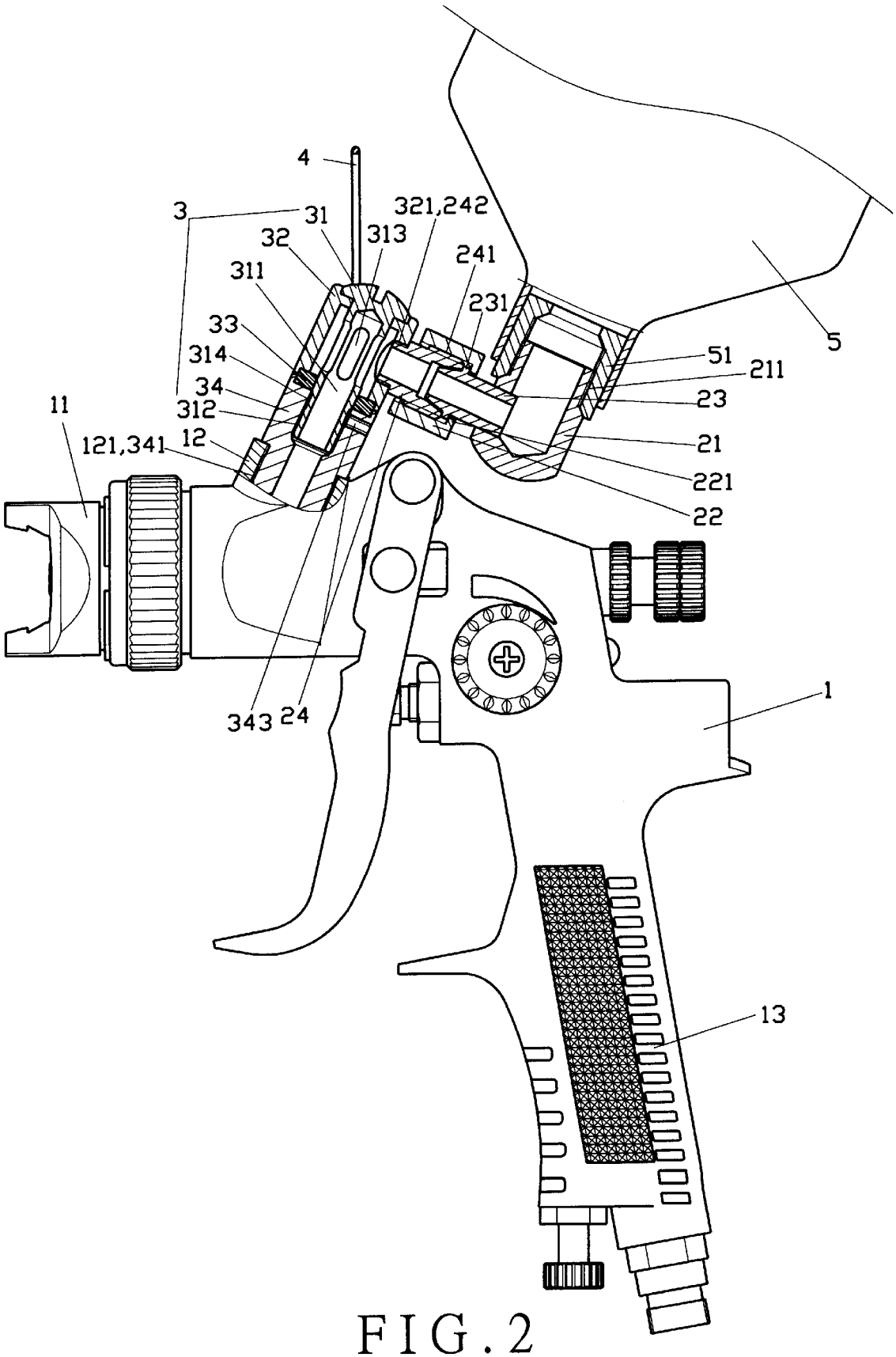
FIG. 2 is a perspective view of a first embodiment of the present invention, partially sectioned.

In assembling, as shown in FIG. 2, the L-shaped connector 2 is connected with its socket 23 to the bolt 22, and the cone 232 facing the inner cone wall of the connecting pipe 24, the connecting pipe 24 is connected to the bolt 22 at its larger threaded portion 241, the socket 23 has one end secured to the opening 212 of the barrel 21 to form the L-shaped connector 2, wherein the flange 231 of the socket 23 engages with the flange 221 of the bolt 22, the other end of the socket 23 which connected to the barrel 21 is able to rotate in 360 degrees with respect to a vertical direction. The barrel 21 is further connected to the opening 51 of the container 5.

The horizontal connector 3 is formed by inserting the shaft 31 through washer 33 and into the connecting wrench 32 and secured to the sleeve 34 with the threads 312 to the 344, insert the pin 343 into the pin hole 342 and the horizontal connector 3 is formed. The clip 4 is secured to the connecting wrench 32 by inserting the two ends into the locator 322, and the threaded portion 341 of the sleeve 34 of the horizontal connector 3 is connected to the female threads 121 of the top connecting head 12 of the spray gun 1, and whereas the small thread 242 of the connecting pipe 24 of the L-shaped connector 2 is threaded into the threaded hole 321 of the connecting wrench 32 of the horizontal connector 3.

Figure 3:
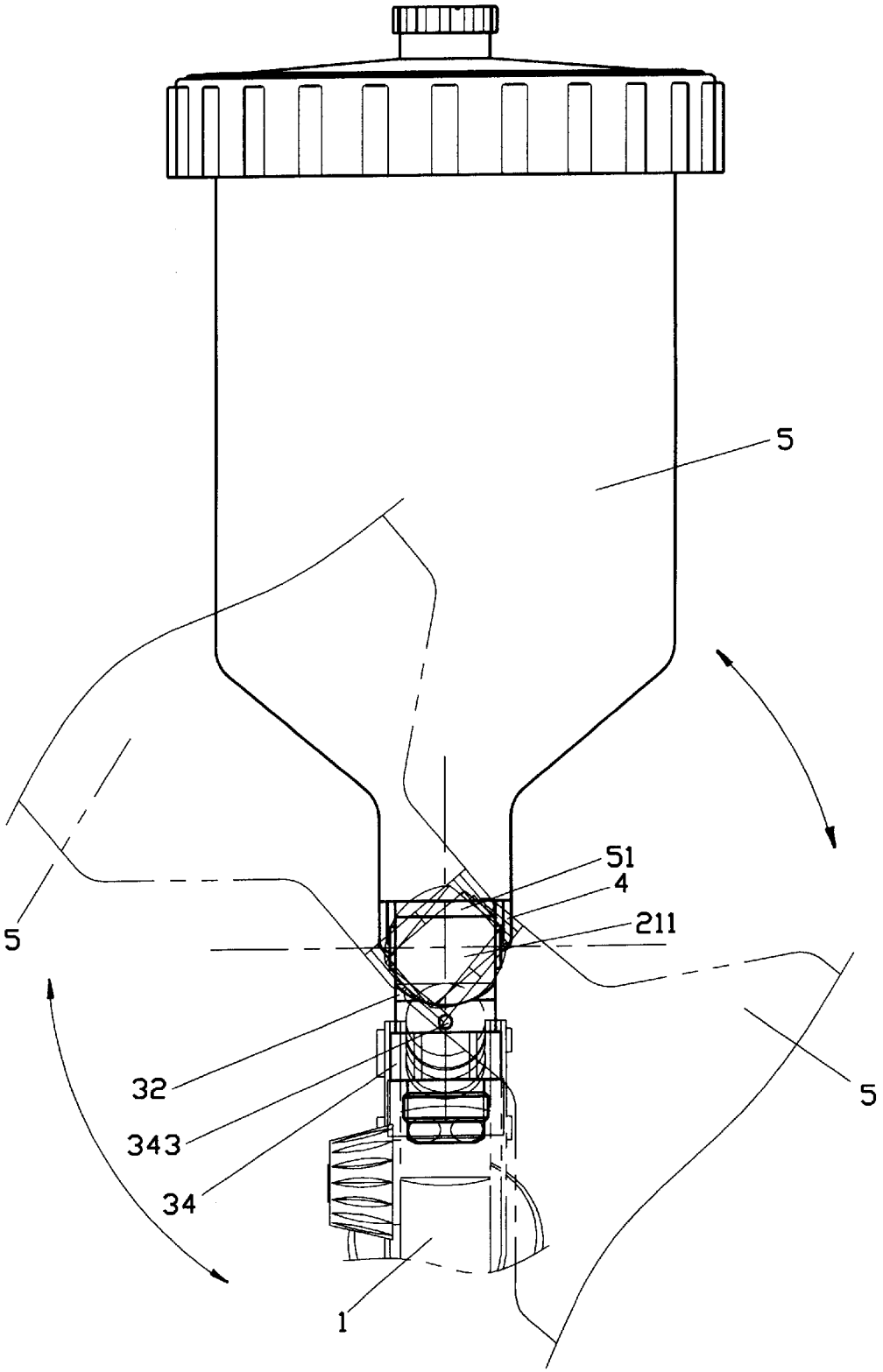
FIG. 3 is a perspective view of the container and its connection with the spray gun.
Figure 4:
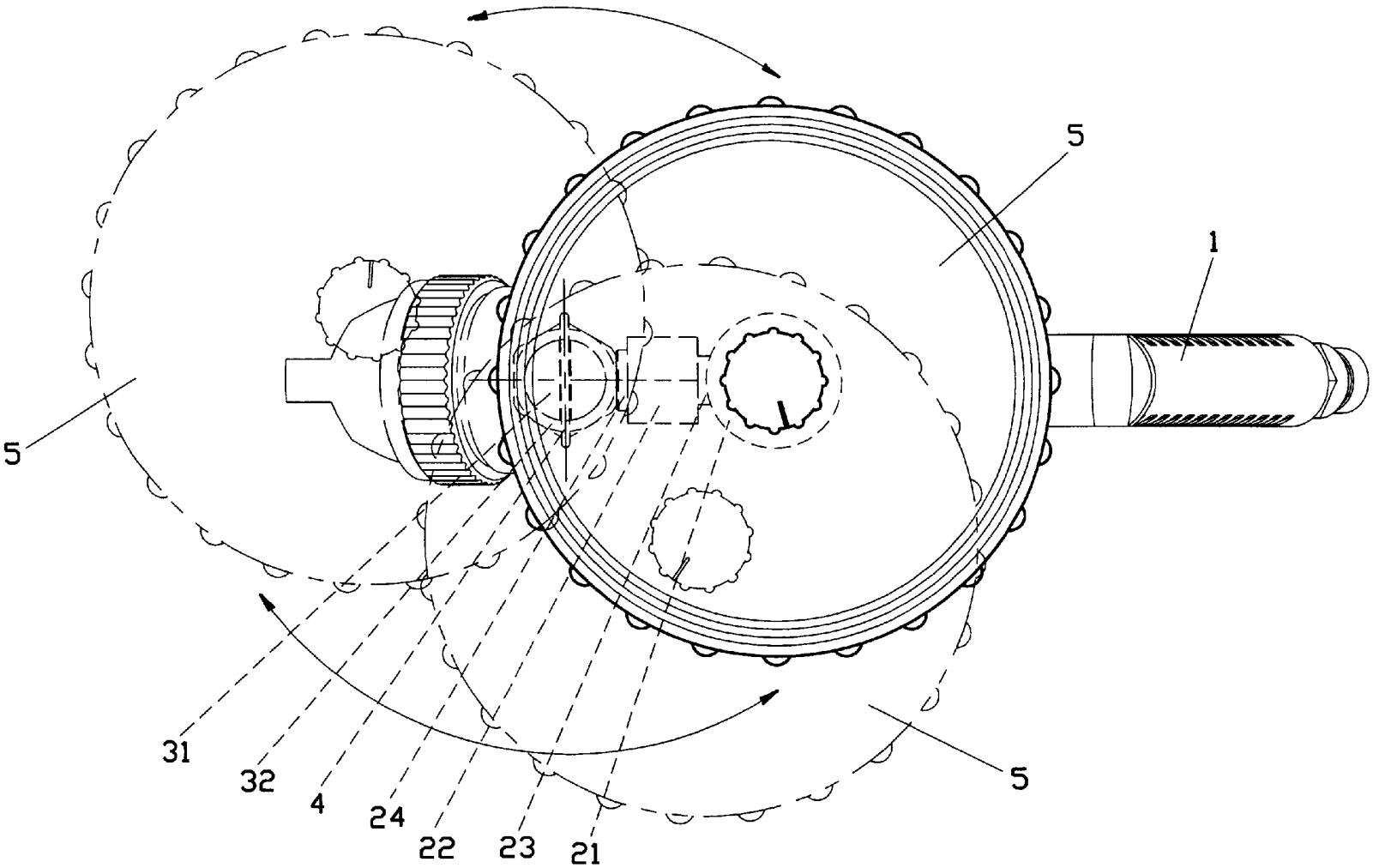
FIG. 4 is another view similar to FIG. 3, showing the container in a different position.

With the above design, as shown in FIG. 3, the container 5 is able to make a horizontal 360 degrees rotation against the L-shaped connector 2 and the horizontal connector 3, as shown in FIG. 4, whereas the container 5 may rotate 360 degrees in vertical direction with respect to the spray gun 1.

The clip 4 may be holding the spray gun 1 in hanging on any protruding object.

Figure 5:
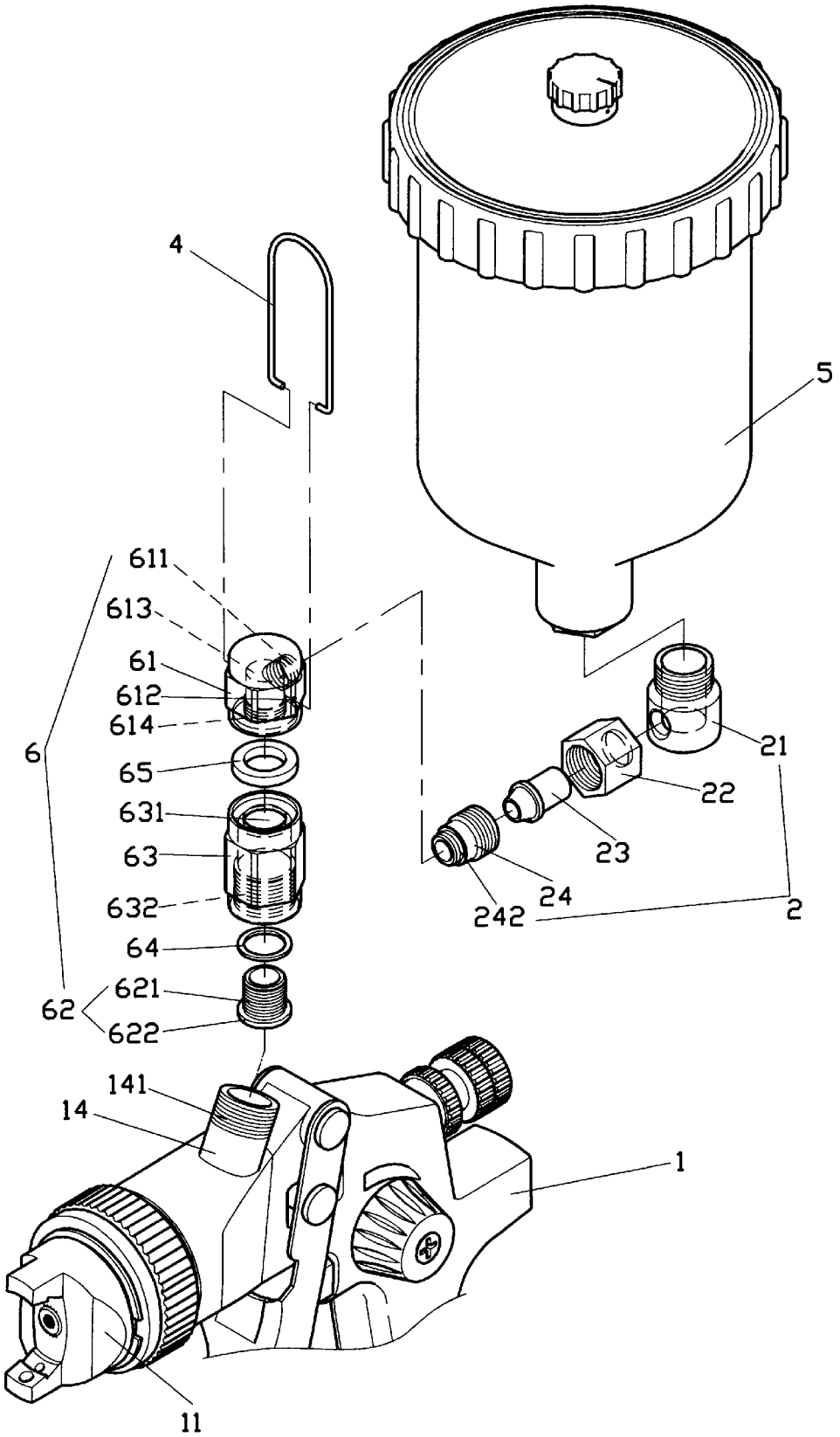
FIG. 5 is an exploded view of a second embodiment of the present invention.

Further, the second embodiment of the present invention, as shown in FIG. 5 which has made a change with respect to the first embodiment, these changes are mainly in the horizontal connector 6 and the threads portion 141 to match the new designed horizontal connector 6, wherein the horizontal connector 6 is composed of a connecting wrench 61, a base 62, a sleeve 63, a washer 64 and a pad 65, the connecting wrench 61 has a threaded hole 611 at its side for threaded connected with the connecting pipe 24, connecting wrench 61 has a pair of locators 612 at respective sides for receiving the clip 4, the connecting wrench 61 has one end enclosed and inside there is a hole 613 interconnected with the threaded hole 611, the hole 613 has a female threads 614 at its bottom portion, the base 62 is a hollow body with male threads 621 at one end and a flange 622 at the lower end, the sleeve 63 has a hole 631 with female threads 632 at the opening end having formed with a step thereat.

Figure 6:
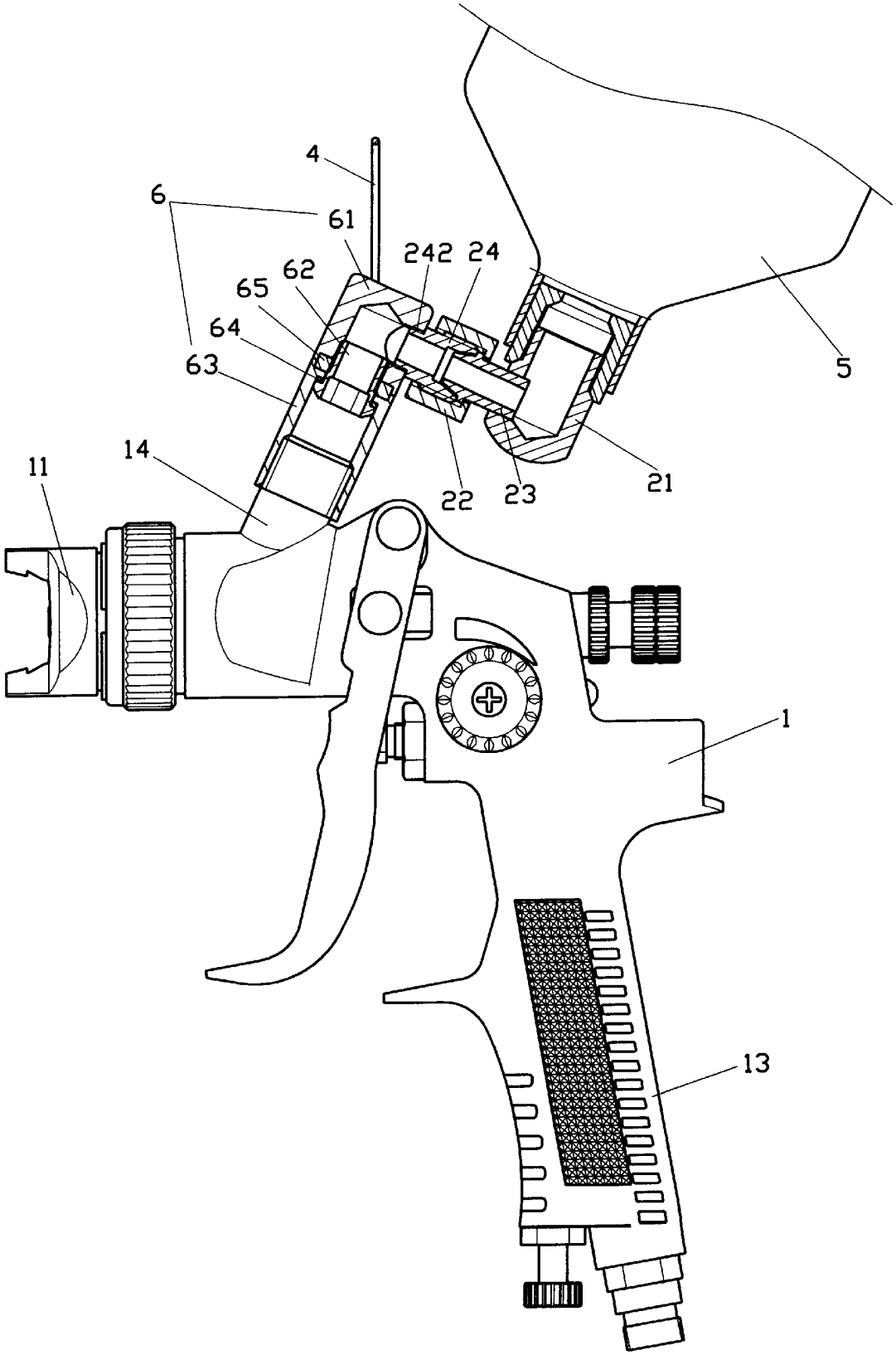
FIG. 6 is a perspective view of the second embodiment of the present invention, partially sectioned.

To assemble, as shown in FIG. 6, insert the base 62 through the washer 64 and then into the hole 631 with the flange 622 of the base 62 against the step, sleeve the other washer 65 onto the female thread 614 to secured thereat. This has connected the connecting wrench 61 and the sleeve 63 to be secured together. The female thread 632 of the sleeve 63 of the horizontal connector 6 secured to the side connecting head 141 of the top connecting head 12 of the spray gun 1, and the hole 611 of the connecting wrench 61 of the horizontal connector 6 is secured to the small threads 242 of the connecting pipe 24 of the L-shaped connector 2.

Figure 7:
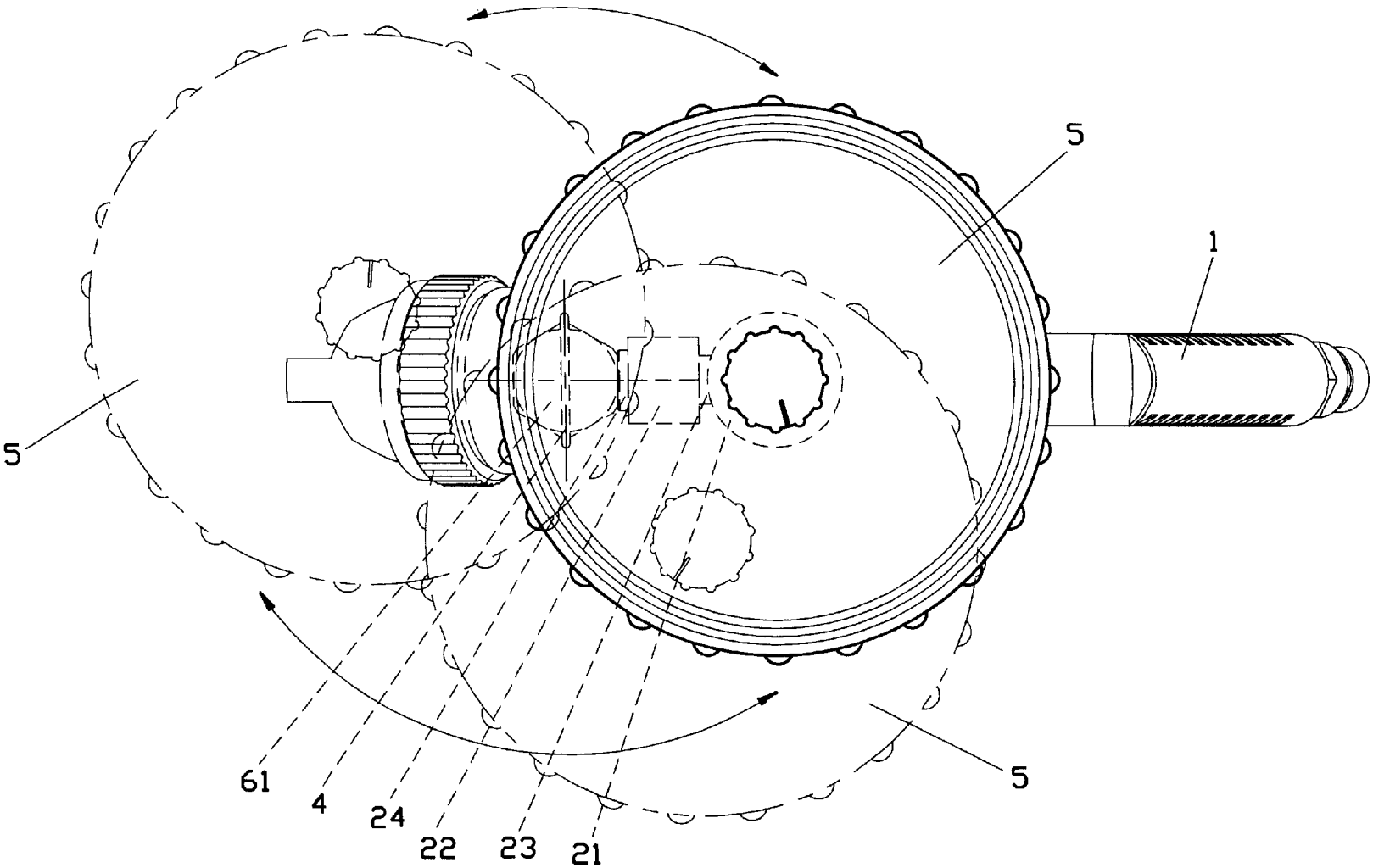
FIG. 7 is a perspective view showing the second embodiment of the container and its connection with the spray gun.

In practice, as shown in FIG. 7, the container 5 and the L-shaped connector 2 and the connecting wrench 61, the base 62 is able to rotate with respect to the spray gun 1.

Figure 8:
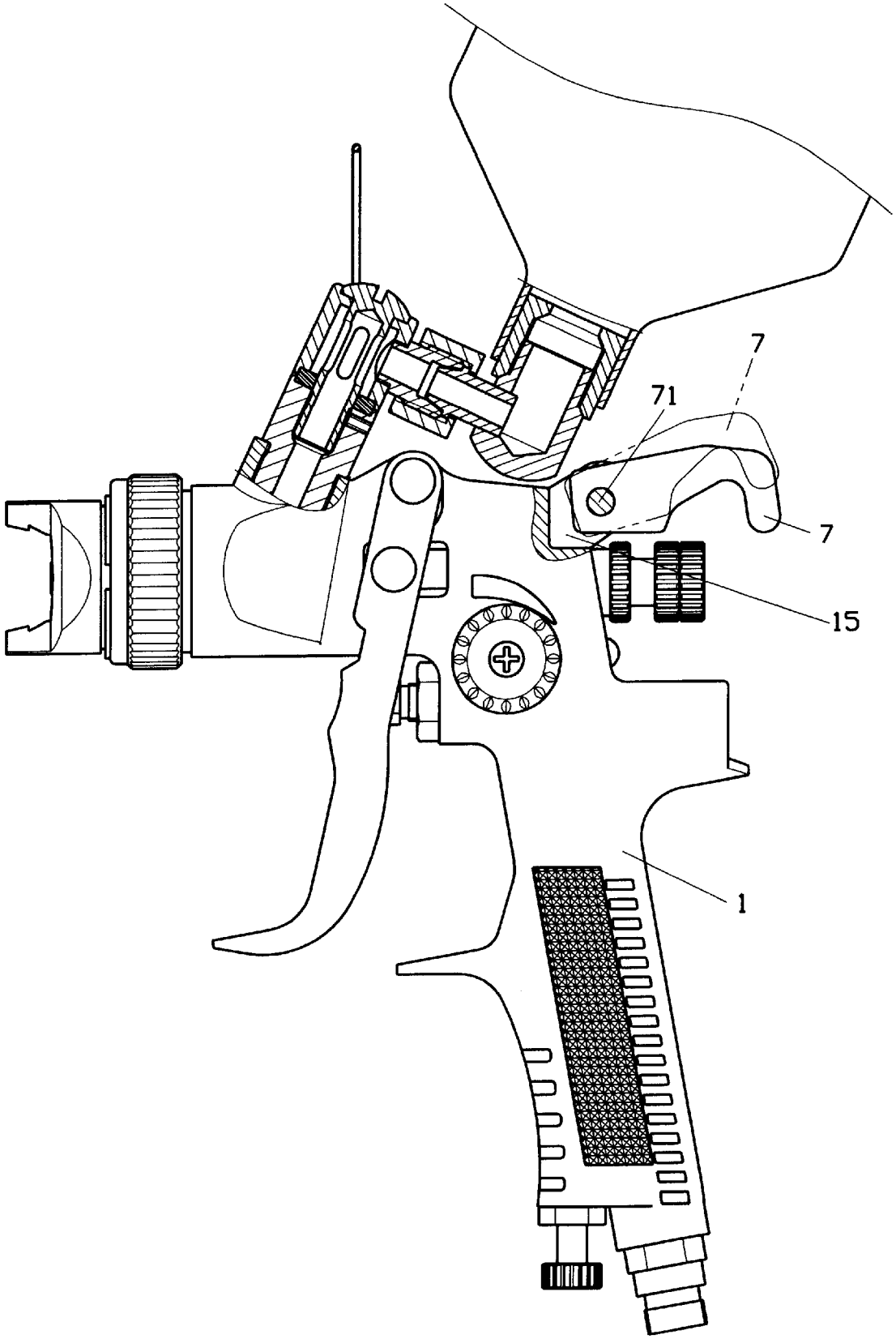
FIG. 8 is a perspective view of a combination of the first and the second embodiments with an new designed hook, having partially sectioned.
Figure 9:
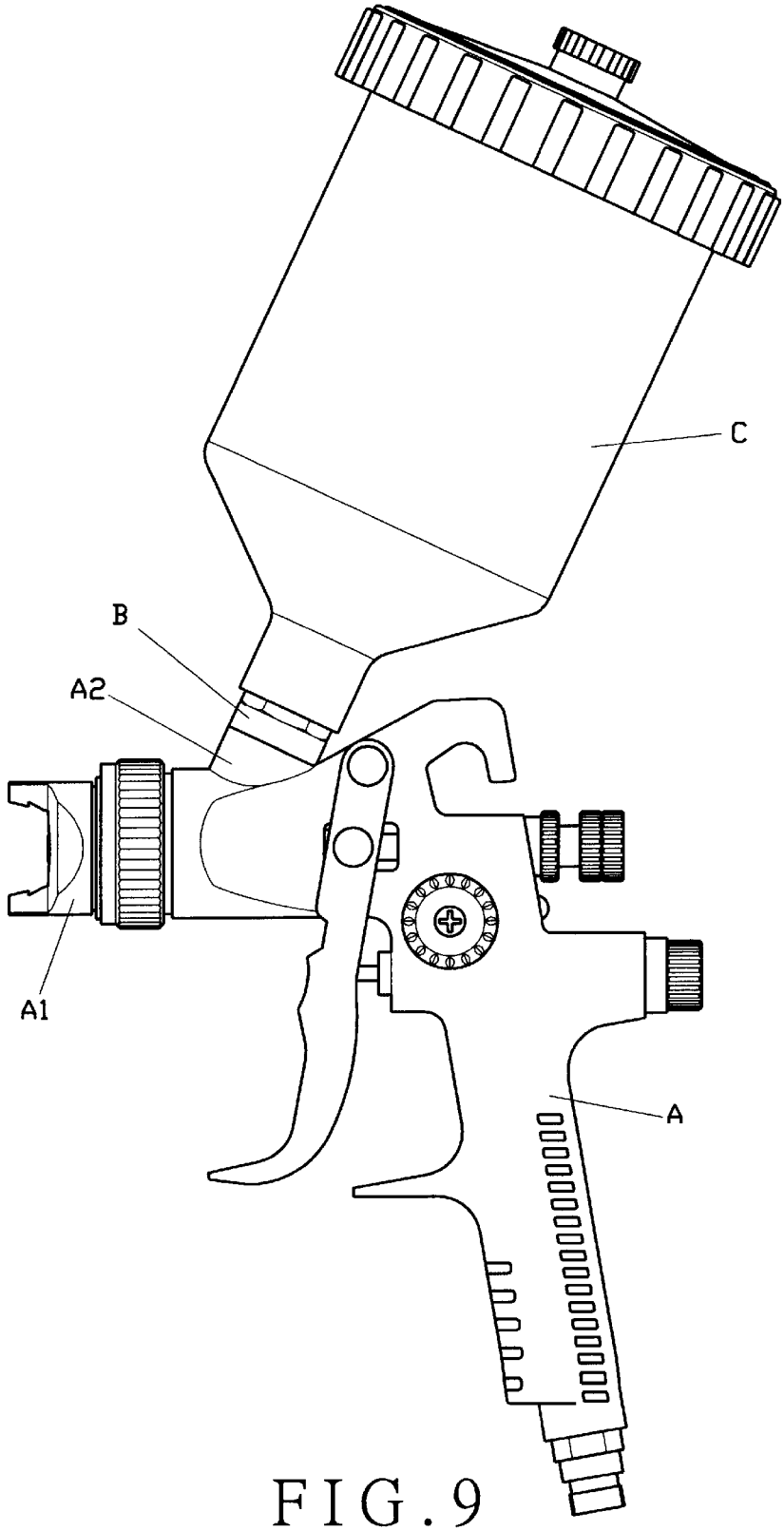
FIG. 9 (PRIOR ART)
FIG. 9 is a perspective view of a prior art.

The present invention may be used along with a hook 7, as shown in FIG. 8 which is attached to the spray gun by inserting pin 71 into a recess 15.

I claim:

1. A structure of a paint container for spray gun comprising an L-shaped connector, a horizontal connector, a spray gun and a paint container, and a top connecting head being integral to a front end of said spray gun, and the improvements comprising, said horizontal connector being secured to said top connecting head and said L-shaped connector being secured to a connecting wrench of said horizontal connector, and said paint container being connected to said horizontal connector, thus, each of said horizontal connector and said L-shaped connector is able to rotate in 360 degrees with respect to each other, and said paint container and said spray gun is able to rotate in 360 degrees with respect to each other too.

2. The structure of a paint container for spray gun, as recited in claim 1, wherein said L-shaped connector comprises a barrel, a bolt, a socket and a connecting pipe, said barrel being a hollow body with an opening at one side, said bolt comprising a small flange, said socket having a hollow body with a ring of flange extending outwardly and a cone at one end thereof, said connecting pipe comprising also a hollow body with a pair of thread portions, one large thread being formed on one end and a small thread on the other end, an inner cone wall being formed at the end portion corresponding to said cone of said socket of said L-shaped connector.

3. The structure of a paint container for spray gun, as recited in claim 1, wherein said horizontal connector comprises a shaft, said connecting wrench, a washer and a sleeve, said shaft having an aperture along the axle, one end of said shaft having a slot, while the other end of which having a thread, at least two longitudinal slots being formed along the wall of said shaft interconnected with said aperture, a ditch being formed thereon, said connecting wrench being in a hexagonal shape with a through threaded hole long the axle thereof.

4. The structure of a paint container for spray gun, as recited in claim 3, wherein said horizontal connector comprises two locators outside thereof and corresponding to each other to secure a clip thereon.

5. The structure of a paint container for spray gun, as recited in claim 1, wherein said horizontal connector comprises said connecting wrench, a base, a sleeve, a washer and a pad, said connecting wrench having a threaded hole at its side and having one end enclosed and an inner hole interconnected with said threaded hole, said hole having a female threads at a bottom portion, said base having a hollow body with male threads at one end and a flange at a lower end, said sleeve having a blind hole with female threads at an opening end formed with a step thereat.

6. The structure of a paint container for spray gun, as recited in claim 5, wherein said horizontal connector comprises two locators outside thereof and corresponding to each other to secure a clip thereon.

7. The structure of a paint container for spray gun, as recited in claim 1, wherein said spray gun has a recess for insertion of a pin to secure a hook thereat.

* * * * *